United States Patent [19]

Yamanaka

[11] 4,201,795

[45] May 6, 1980

[54] HANDY CONTAINER-PAN FOR INSTANTLY FRIZZLABLE DRY FOODS

[75] Inventor: Kenji Yamanaka, Komae, Japan

[73] Assignee: Toyo Suisan Kaisha, Ltd., Tokyo, Japan

[21] Appl. No.: 919,807

[22] Filed: Jun. 28, 1978

[51] Int. Cl.[2] ..... B65D 81/34

[52] U.S. Cl. ..... 426/110; 206/216; 220/94 R; 229/43; 426/113; 426/396; 229/3.5 MF

[58] Field of Search ..... D7/85, 95; 220/256, 220/257, 258, 94 R; 426/106, 112, 110, 113, 114; 229/3.5 MF, 43; 206/216

[56] References Cited

U.S. PATENT DOCUMENTS

| | | | |
|---|---|---|---|
| D. 186,900 | 12/1959 | Griese | 229/3.5 MF X |
| 1,995,820 | 3/1935 | Royle | 229/43 |
| 2,453,393 | 11/1948 | Wilson | 229/43 X |
| 2,673,806 | 3/1954 | Colman | 426/113 |
| 2,728,516 | 12/1955 | Rodman | 206/216 X |
| 2,975,931 | 3/1961 | Harrison | 229/43 X |
| 3,219,460 | 11/1965 | Brown | 426/107 |
| 3,495,758 | 2/1970 | Wienecke, Jr. | 229/43 |
| 3,672,916 | 6/1972 | Virnig | 229/43 |

*Primary Examiner*—Stephen P. Garbe

*Attorney, Agent, or Firm*—Frishauf, Holtz, Goodman and Woodward

[57] ABSTRACT

A container-pan used for instantly frizzlable dry foods is made of an aluminum foil sheet having a scoop-type grip formed integrally with upper edge portion of the pan; a cardboard lid to be put on the pan-and-grip, crossed lines being press-marked thereon for inflection; and a shrink-packaging polymer film for steadfastly attaching the lid to the pan-and-grip. To frizzle a dry food mass which has been received in the pan, the polymer film and the lid are removed from the pan-and-grip. The lid is then folded to form a hinge-like protecting cover and is used for wrapping up the grip now heated.

5 Claims, 7 Drawing Figures

HANDY CONTAINER-PAN FOR INSTANTLY FRIZZLABLE DRY FOODS

This invention relates to a handy container-pan used for instantly frizzlable dry foods.

Recently, the so-called "instantly pan-cookable dry noodles food" has been put on the market. A mass of noodles with a bagged soup and other ingredients is packed in a container-pan. The container-pan consists of a handy pan made of an aluminum foil sheet, having a lug attached integrally thereto, a cardboard lid to be put on the pan, and a shrink-packaging polymer film for steadfastly attaching the lid to the pan.

When the above-mentioned food is boiled, the shrink packaging polymer film and the cardboard lid are taken away from the handy pan, followed by dusting the dry noodles mass with the powdered soup sealed in a small bag. Then, about 500 cc of cool or hot water is poured into the pan, followed by heaing the pan. By boiling for about 3 minutes, an eatable noodles food can be easily obtained.

In the above case, it is almost unnecessary to grasp the lug while boiling because there is no need of giving a stirring motion to the content of the pan.

On the other hand, it is certainly necessary to grasp the heated pan when instantly frizzlable dry foods are cooked to prepare a frizzled dish such as chow mein and pilaf. This is because these dishes cannot be prepared without a vigorous stirring of the mass in the pan. It is very dangerous, however, to grasp the pan heated to a high temperature with a bare hand.

An object of this invention is to provide a handy container-pan used for instantly frizzlable dry foods, which can be grasped without burning fingers or palm while the dry food is being cooked.

SUMMARY OF THE INVENTION

This object can be attained according to this invention comprises a container-pan made of an aluminum foil sheet having a scoop-type grip formed integrally with upper edge portion of the pan; a cardboard lid to be put on the pan-and-grip, which has crossed lines for inflection press-marked on the surface thereof; and a shrink packaging polymer film for steadfastly attaching the lid to the pan-and-grip.

This invention can be more fully understood from the following detailed description when taken in conjunction with the accompanying drawings.

BRIEF DESCRIPTION

Figure 1:
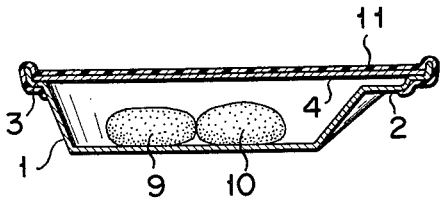
FIG. 1 is a longitudinal sectional view of one embodiment of a container-pan according to this invention.
Figure 2:
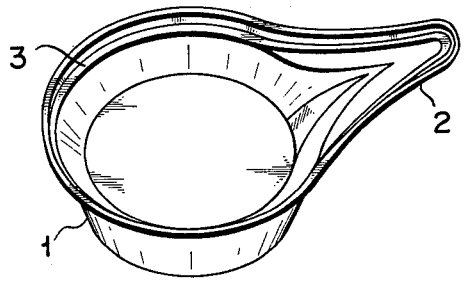
FIG. 2 is a perspective view of the pan-and-grip of the container-pan shown in FIG. 1, with the lid removed.

A handy container-pan 1 shown in FIGS. 1 and 2 is made of an aluminum foil sheet by press-molding. The container-pan 1 has a scoop-type grip 2 which is formed integrally with an upper edge portion of the pan 1.

Further, a wall step 3 is formed along the whole inner side of an upper periphery of the container-pan 1 including the grip 2.

Figure 3:
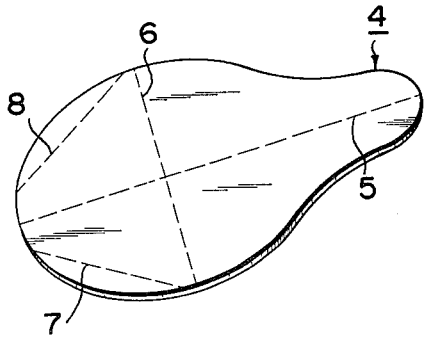
FIG. 3 is a perspective view of a lid to be attached to the container-pan shown in FIG. 2.

As illustrated in FIG. 3, a cardboard lid 4 has the same shape of a long egg as the wall step 3. It has crossed lines 5 and 6 press-marked on its surface. Along these crossed lines the lid 4 is to be folded. It is preferable that an additional two free inflection chord-like lines 7 and 8 are press-marked on the half-round surface of the lid 4 in slantwise directions with respect to the crossed lines 5 and 6.

A mass 9 of instantly frizzlable dry food and a small bag containing powdered soup and othe ingredients 10 are put into the container-pan 1. Then the lid 4 is put on the wall step 3. Thereafter the container-pan 1 with the grip 2 and the lid 4 are wrapped up by a shrink-packaging polymer film 11 so that the lid 4 is steadfastly attached to the container-pan 1. Thus, a commercially available instantly frizzlable dry food can be obtained.

When the above-mentioned instantly frizzlable dry food is to be eaten, the lid 4 is removed from the container-pan 1 having a grip 2 after taking the covering polymer film 11 away. The mass of frizzlable food is dusted with the powdered soup together with a small-amount of water and oily substance in the open container-pan 1. Then the pan is heated, while stirring vigorously the content thereof by one hand using a fork or chopsticks.

During this operation, the pan should be kept in a fixed state on a heating appliance. This can be accomplished by grasping the grip 2 of the pan 1 with a hand. However, the grip 2 is very hot, and it is very dangerous to touch the grip with a bare hand. In order to avert this danger, the lid 4 removed from the container-pan 1 can be used effectively so that the lid 4 forms a protecting cover for the hot grip 2.

Figure 4:
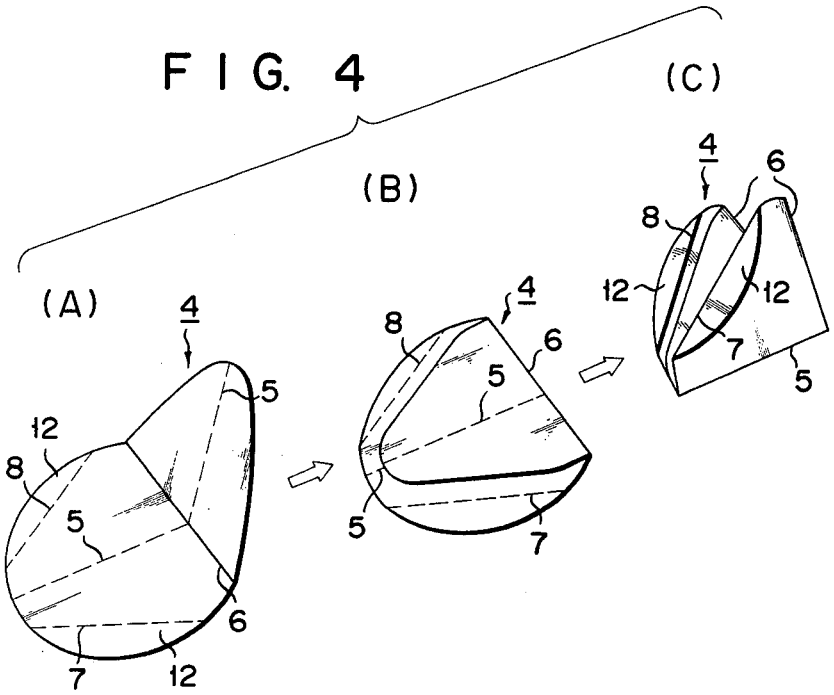
FIGS. 4A to 4C are explanatory perspective views showing the folding order of the lid of FIG. 3.

The lid 4 is folded first along the widthwise inflection line 6 as shown in FIG. 4A until it is bent double as shown in Fig. 4B. Then the doubled-over lid 4 is again folded along the lengthwise inflection line 5 to obtain a hinge-like shape as shown in FIG. 4C. Further, it is desired that two arc parts 12 of the lid 4 be folded along the chord-like inflection lines 7 and 8 to form two small wings which are attached to the lid 4 now in the form of a hinge.

Figure 5:
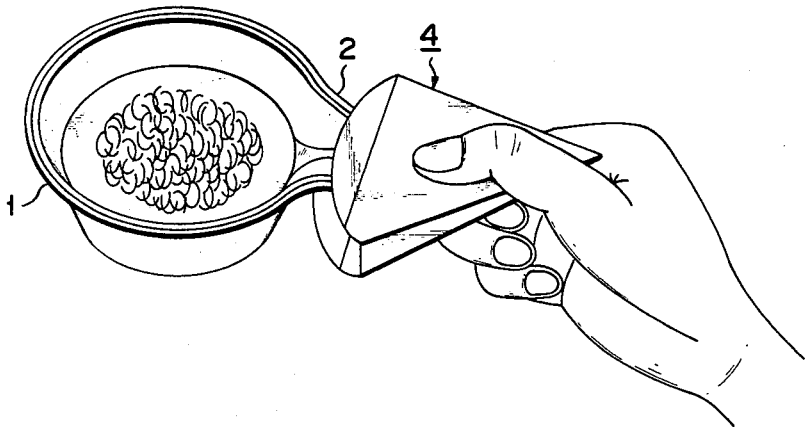
FIG. 5 is an explanatory perspective view showing a mode of using the folded lid.

As shown in FIG. 5, the lid 4 in the form of a hinge is held between the thumb and the foreginger, thereby to grasp the grip 2 which is now very hot. Thus the grip 2 is held by hand indirectly by means of the protecting cover, i.e. the folded lid 4. The folded lid 4 insulates the heat from the hand, and the food in the container-pan 1 can therefore be cooked easily without making the cook feel any danger or causing him any trouble.

What is claimed is:

1. In a handy container-pan assembly including therein an instantly frizzlable dry food, comprising a pan made of aluminum foil and having a scoop-type grip made of aluminum foil and integrally formed with an upper part of the pan, the pan having a wallstep formed at least on the whole inner and upper periphery of the pan; a cardboard lid mountable on said wallstep for closing the pan; and a shrink-packaging polymer film surrounding said pan and lid for attaching said lid to the pan;

The improvement wherein said lid has a pair of crossed lines press-marked thereon for inflection of the lid on said crossed lines to form a doubly inflected lid which is slideably mounted over the scoop-type grip of the pan for protecting the user when the pan, and consequently the grip, is heated during heating of the dry food in the pan.

2. The container-pan assembly of claim 1, wherein the cardboard lid has two further chord-like lines press-marked on the lid for protective inflection thereof in slantwise directions with respect to said pair of crossed lines.

3. The container-pan assembly of claim 1, wherein said scoop-type grip is integrally formed with the upper edge portion of the pan.

4. The container-pan assembly of claim 1 wherein said lid has substantially the same shape as the contour defined by said wallstep.

5. The container-pan assembly of either of claim 1 or 4 wherein said wallstep is formed also around the whole upper periphery of said scoop-type grip and is continuous with said wallstep formed around said pan, said lid being shaped to have a portion thereof received in said wallstep of said scoop-type grip.

* * * * *

UNITED STATES PATENT AND TRADEMARK OFFICE

CERTIFICATE OF CORRECTION

PATENT NO. : 4,201,795

DATED : May 6, 1980

INVENTOR(S) : Kenji YAMANAKA

It is certified that error appears in the above—identified patent and that said Letters Patent is hereby corrected as shown below:

In the Abstract, last line, change "now" to --which becomes--;

Column 1, line 40, change "comprises" to --which comprises--;

line 64, change "BRIEF DESCRIPTION" to --DETAILED DESCRIPTION--;

Column 2, line 2, change "an" to --the--.

Signed and Sealed this

*Fourth* Day of *November 1980*

[SEAL]

*Attest:*

SIDNEY A. DIAMOND

*Attesting Officer*

*Commissioner of Patents and Trademarks*